US007398777B2

(12) United States Patent
Carnall et al.

(10) Patent No.: US 7,398,777 B2
(45) Date of Patent: Jul. 15, 2008

(54) VALVE OPERATING BETWEEN TELESCOPIC COMPONENTS WITH O-RING SEALS

(75) Inventors: Martin Carnall, Barwell (GB); Paul Garry, Manchester (GB)

(73) Assignee: Black Market Sportz Limited, Warwickshire (GB)

( * ) Notice: Subject to any disclaimer, the term of this patent is extended or adjusted under 35 U.S.C. 154(b) by 4 days.

(21) Appl. No.: 11/072,547

(22) Filed: Mar. 4, 2005

(65) Prior Publication Data

US 2005/0194558 A1 Sep. 8, 2005

(30) Foreign Application Priority Data

Mar. 5, 2004 (GB) ..... 0404988.8

(51) Int. Cl.
*F41B 11/00* (2006.01)

(52) U.S. Cl. ..... 124/75; 251/325; 251/900

(58) Field of Classification Search ..... 251/324–325, 251/344, 900; 124/71–77
See application file for complete search history.

(56) References Cited

U.S. PATENT DOCUMENTS 2,485,504 A * 10/1949 Myles ..... 251/324
2,621,885 A * 12/1952 Schmitt ..... 251/324
3,199,540 A * 8/1965 Forster ..... 251/324
4,991,654 A * 2/1991 Brandell et al. ..... 251/343
5,297,777 A * 3/1994 Yie ..... 251/324
5,333,594 A * 8/1994 Robinson ..... 124/73
5,538,042 A * 7/1996 Baland ..... 251/900
5,613,483 A * 3/1997 Lukas et al. ..... 124/73
5,769,066 A * 6/1998 Schneider ..... 124/75
5,881,707 A * 3/1999 Gardner, Jr. ..... 124/77
6,516,791 B2 * 2/2003 Perrone ..... 124/77
6,644,295 B2 * 11/2003 Jones ..... 124/77
7,185,646 B2 * 3/2007 Jones ..... 124/74
2005/0115554 A1 6/2005 Jones

* cited by examiner

*Primary Examiner*—John Bastianelli
(74) *Attorney, Agent, or Firm*—Caesar, Rivise, Bernstein, Cohen & Pokotilow, Ltd.

(57) ABSTRACT

A valve for communicating a source 14 of compressed fluid with an opening 13 of an adjacent chamber 12 in a sleeve 11 comprises a circumferentially separated array of depressions 15 in the outer periphery of a bolt 10. Areas 19 and 20 of the bolt periphery between the depressions 15 serve to support the radially inner side of an O-ring seal 16 when the latter is aligned with the depressions.

18 Claims, 2 Drawing Sheets

VALVE OPERATING BETWEEN TELESCOPIC COMPONENTS WITH O-RING SEALS

This application is related to and claims priority from British Patent Application No. 0404988.8 filed Mar. 5, 2004.

This invention relates to a valve and more particularly to a valve between two elongated, telescopic components which can communicate axially spaced openings of the outer component when aligned with an axially elongated depression in the outer periphery of the inner component.

BACKGROUND OF THE INVENTION

A valve of this kind is used in the paintball gun of our co-pending United States Patent Applications one of which is Ser. No. 10/775,756 and was filed on Feb. 9, 2004 and the other of which is Ser. No. 10/870,687 and was filed on Jun. 17, 2004. In those Applications the valve is used to communicate a source of compressed air with a chamber in which it is stored prior to being released through the bolt of the gun. When the gun is fired the valve serves to isolate the chamber from the source so that only the air stored in the chamber is used to fire a paintball.

In any pneumatic or hydraulic system using telescopic components it is necessary to provide O-ring seals in respective circumferential grooves on opposite sides of an opening in one of the components communicating with the source of compressed fluid if that opening is to be successfully occluded by the other component in the closed position of the valve. In the absence of such seals the compressed fluid may escape between the components.

According to the proposals of our said co-pending patent applications one of the O-ring seals on opposite sides of a bore communicating with a canister of compressed air must pass to or beyond the circumferential depression in the outer periphery of the bolt in order to communicate the bore with the interior of the storage chamber. The system works quite well but there is a danger that the said one O-ring may become deformed when it is aligned with the depression and therefore unsupported by the periphery of the bolt. The pressurised air entering the groove of the said O-ring may tend to displace it. Thus when the bolt moves back from its firing position the deformed or displaced O-ring may jam in the depression causing the mechanism to "lock up".

A principal object of the present invention is to offer a solution to this problem.

SUMMARY OF THE INVENTION

In accordance with one aspect of the present invention there is provided a valve operating between telescopic components to control communication between a source of pressurised fluid and an outlet by means of an O-ring seal axially displaceable with one of said components relative to an axially elongated opening in the other component, characterised in that said opening does not extend throughout the circumference of said other component such that when said O-ring is aligned with said opening to open communication between said source and said outlet it is supported by the peripheral surface of said other component on opposite circumferential sides of said opening.

Said opening is preferably one of a plurality of similar openings circumferentially spaced around said other component. The inner component may be tubular and said openings may be slots in the inner component which communicate its outer periphery with its interior.

Alternatively the openings may be depressions in the outer periphery of the inner component.

According to another aspect of the present invention there is provided a valve operating between telescopic components to bring axially spaced openings in the outer component into or out of alignment with an axially elongated depression in the outer periphery of the inner component, a pair of O-ring seals being positioned between the components in respective circumferential grooves on opposite sides of one of said openings, characterised in that the depression does not extend throughout the circumference of the inner component such that when one of said seals moves relatively into alignment with said depression to communicate said openings said one seal is supported by the outer periphery of the inner component on opposite circumferential sides of the depression.

Preferably the depression is one of a plurality of depressions spaced circumferentially about the outer periphery of the inner component.

In a preferred embodiment of the invention the components are respectively a sleeve and a bolt telescopically slideable within the sleeve, the sleeve and bolt being part of the mechanism of a paintball gun and the valve serving to communicate a chamber in the sleeve with a source of compressed air in a retracted position of the bolt and to isolate the chamber from the source in a firing position of the bolt.

BRIEF DESCRIPTION OF THE DRAWINGS

A preferred embodiment of the invention will now be described by way of non-limitative example with reference to the accompanying drawings, in which.

DETAILED DESCRIPTION OF A PREFERRED EMBODIMENT

Figure 1:
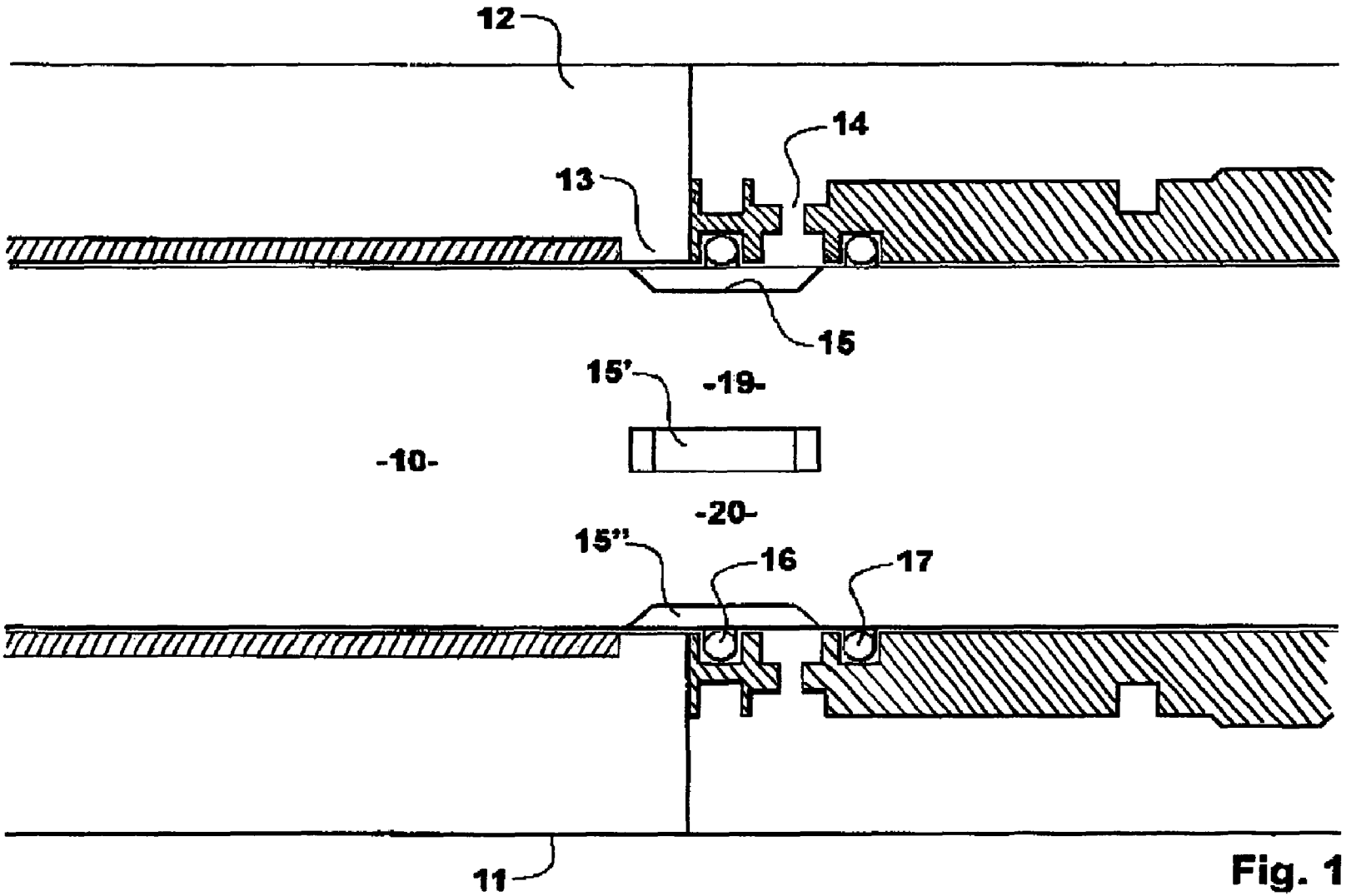
FIG. 1 is a partial sectional elevation of a bolt of a paintball gun and a surrounding sleeve showing a valve in accordance with the invention in an open position.
Figure 2:
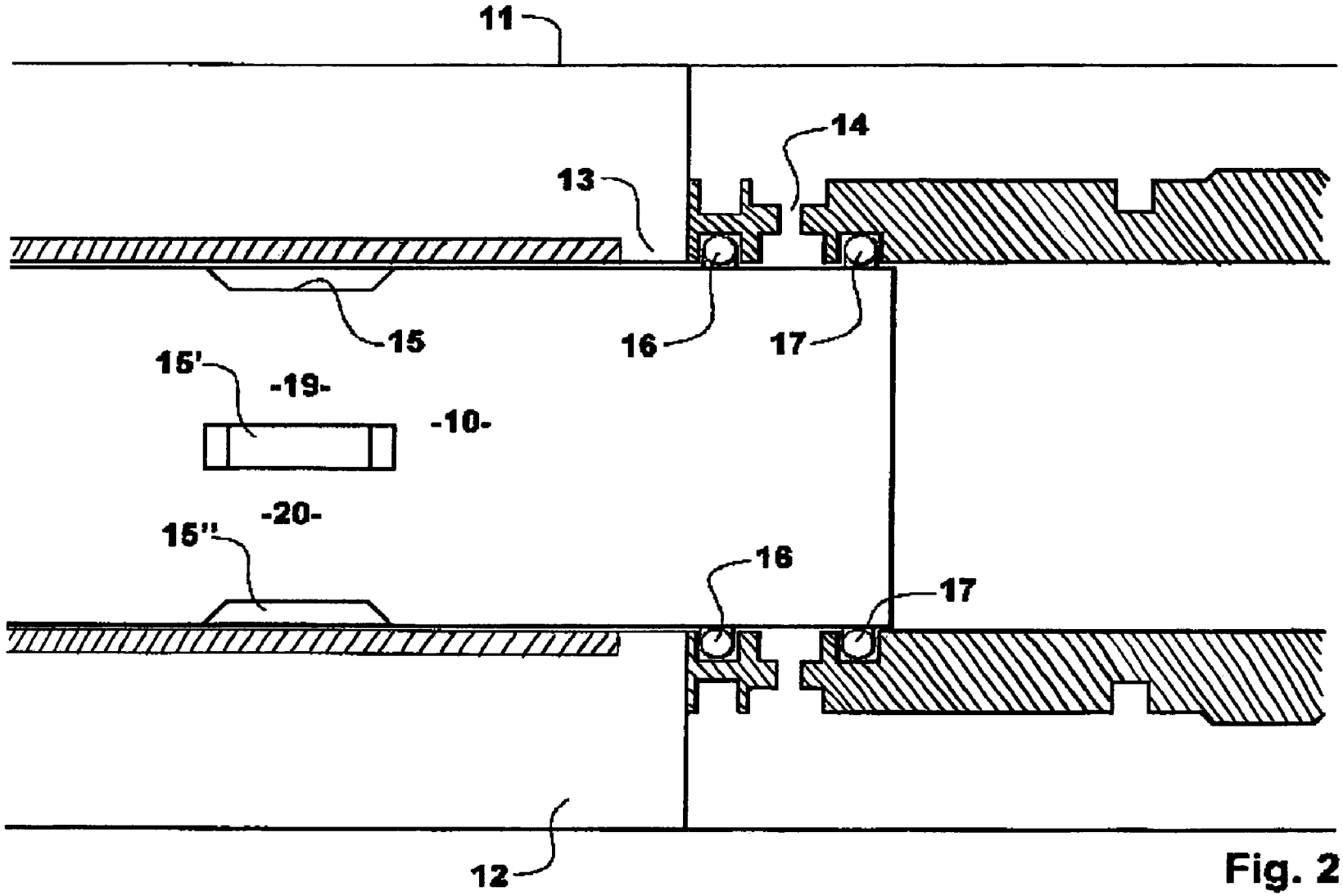
FIG. 2 is a view similar to FIG. 1 but showing the valve in the closed position.

As described in our said co-pending patent applications, to which reference is made for a clearer understanding of the present invention, the bolt 10 of a paintball gun slides telescopically within a sleeve between a retracted position in which it is shown in FIG. 1 and a firing position in which it is shown in FIG. 2, in the latter position the interior of the bolt communicating with the interior of a chamber 12 in the sleeve so that compressed air stored in the chamber 12 will exit through the bolt to fire a paintball. In the retracted position of the bolt of FIG. 1 openings (not shown) of the chamber 12 to the interior of the bolt 10 and of the bolt 10 to the chamber 12 are misaligned so that the chamber is isolated from the bolt interior. On the other hand the chamber 12 communicates by an axially elongated opening 13 with a bore 14 connected to a source of compressed air (not shown) via a depression 15 in the outer periphery of the bolt 10. In the firing position of the bolt 10 (FIG. 2) however the depression moves out of alignment with the opening 13 and bore 14 and the periphery of the bolt 10 occludes both of them.

A pair of O-ring seals 16 and 17 are positioned in respective circumferential grooves in the sleeve 12 on opposite sides of the bore 14. Thus when the bolt 10 moves to the retracted position of FIG. 1 one of them, the seal 16, comes into alignment with the depression 15. If the depression 15 extended around the full circumference of the bolt 10 the seal 16 would be unsupported on its radially inner side. In accordance with the present invention, however, the depression 15 has only a small circumferential extent and is one of an array of such depressions such as 15' and 15". As the depressions 15 are machined out of the outer periphery of the bolt 10 portions such as 19 and 20 of the outer periphery of the bolt on opposite circumferential sides of the depressions support the seal 16 on its radially inner side while it is aligned with the depressions.

We claim:

1. A mechanism for a paintball gun comprising a valve operating between telescopic components of a paintball gun mechanism to control communication between a source of pressurised fluid and an outlet by means of at least one axially elongated opening in a first of the components which is axially displaceable relative to an O-ring seal associated with a second of the components between a retracted position, in which the source of pressurised fluid and the outlet are in fluid communication, and a firing position, in which the source of pressurised fluid is isolated from the outlet, wherein the at least one opening extends about a minor portion of the circumference of the first component such that when the O-ring seal is aligned with the at least one opening to open communication between the source and the outlet, the O-ring seal is supported by an outer peripheral surface of the first component on opposite circumferential sides of the at least one opening.

2. The mechanism for a paintball gun as claimed in claim 1, wherein the at least one opening includes a plurality of openings circumferentially spaced around the first component.

3. The mechanism for a paintball gun as claimed in claim 2, wherein the first component is an inner component which is tubular and the openings are slots in the inner component which communicate its outer periphery with its interior.

4. The mechanism for a paintball gun as claimed in claim 2, wherein the first component is an inner component and the openings are depressions in the outer periphery of the inner component.

5. A valve as claimed in claim 1, wherein the outlet is in fluid communication with a chamber.

6. The mechanism for a paintball gun as claimed in claim 5, wherein the chamber is closed when the first component is in a retracted position.

7. The mechanism for a paintball gun as claimed in claim 1, wherein the components are a bolt and a sleeve of the paintball gun.

8. The mechanism for a paintball gun as claimed in claim 7, wherein the bolt is the first component and the sleeve is the second component.

9. A mechanism for a paintball gun comprising a bolt and a sleeve, the bolt comprising at least one axially elongate depression, the sleeve comprising an inlet, an outlet and an O-ring seal, wherein the bolt is slideable within the sleeve between a retracted position, in which the at least one axially elongate depression is aligned with the O-ring seal to open fluid communication between the inlet and the outlet, and a firing position, in which the at least one axially elongate depression is out of alignment with the O-ring seal to isolate the inlet from the outlet, the at least one axially elongate depression extending about a minor portion of the circumference of the bolt such that, when the O-ring seal is aligned with the at least one depression, the O-ring seal is supported by an outer peripheral surface of the bolt on opposite circumferential sides of the at least one depression.

10. The mechanism for a paintball gun as claimed in claim 9, wherein an outlet from the at least one depression includes a plurality of depressions circumferentially spaced about the outer periphery of the inner bolt.

11. The mechanism for a paintball gun as claimed in claim 9, wherein the outlet is in fluid communication with a chamber.

12. The mechanism for a paintball gun as claimed in claim 11, wherein an outlet from the chamber is closed when the bolt is in the retracted position.

13. The mechanism for a paintball gun as claimed in claim 9, wherein the O-ring seal is located between the inlet and the outlet.

14. The mechanism for a paintball gun as claimed in claim 9, wherein the at least one axially elongate depression is aligned with the inlet and the outlet when the bolt is in a retracted position and is out of alignment with the inlet and/or the outlet when the bolt is in a firing position.

15. The mechanism for a paintball gun as claimed in claim 13, wherein the sleeve comprises a further O-ring seal located on the opposite side of the inlet or the outlet to the O-ring seal.

16. The mechanism for a paintball gun as claimed in claim 9, wherein the O-ring seal is located within a circumferential groove in the sleeve.

17. The mechanism for a paintball gun as claimed in claim 15, wherein the further O-ring seal is located within a respective circumferential groove.

18. The mechanism for a paintball gun as claimed in claim 15, wherein the further O-ring seal is supported by a peripheral surface extending about the entire circumference of the bolt in both the retracted position and the firing position.

* * * * *